US011670273B2

(12) United States Patent
Moon et al.

(10) Patent No.: US 11,670,273 B2
(45) Date of Patent: Jun. 6, 2023

(54) SOUND ABSORPTION DEVICE AND METHOD OF MANUFACTURING THE SAME

(71) Applicant: KOREA INSTITUTE OF SCIENCE AND TECHNOLOGY, Seoul (KR)

(72) Inventors: Myoung-Woon Moon, Seoul (KR); O-Chang Kwon, Seoul (KR)

(73) Assignee: KOREA INSTITUTE OF SCIENCE AND TECHNOLOGY, Seoul (KR)

( * ) Notice: Subject to any disclaimer, the term of this patent is extended or adjusted under 35 U.S.C. 154(b) by 300 days.

(21) Appl. No.: 16/937,582

(22) Filed: Jul. 24, 2020

(65) Prior Publication Data

US 2021/0043182 A1 Feb. 11, 2021

(30) Foreign Application Priority Data

Aug. 5, 2019 (KR) ..... 10-2019-0095164

(51) Int. Cl.
*G10K 11/162* (2006.01)
*E04B 1/86* (2006.01)

(52) U.S. Cl.
CPC ..... *G10K 11/162* (2013.01); *E04B 1/86* (2013.01)

(58) Field of Classification Search
CPC ..... G10K 11/162; E04B 1/86
USPC ..... 181/286
See application file for complete search history.

(56) References Cited

U.S. PATENT DOCUMENTS

2015/0030803 A1* 1/2015 Butler ..... B32B 5/26 264/258
2017/0011729 A1 1/2017 Lee et al.
2017/0200441 A1* 7/2017 Mohammadi Gojani ..... B32B 9/041
2018/0023215 A1* 1/2018 Robertson ..... B01D 46/546 55/527
2019/0070538 A1* 3/2019 Wang ..... D04H 1/43838

FOREIGN PATENT DOCUMENTS

| | | | | |
|---|---|---|---|---|
| CN | 108995329 | A | 12/2018 | |
| JP | 2006299789 | A | 11/2006 | |
| KR | 20170112581 | A | 10/2017 | |
| KR | 1020180017582 | A | 2/2018 | |
| WO | WO-2017184615 | A1 * | 10/2017 | ..... B01D 29/114 |
| WO | 2019/110940 | A1 | 6/2019 | |

OTHER PUBLICATIONS

Korean Office Action for KR Application No. 10-2019-0095164 dated Oct. 27, 2020 citing the above references. In conformance with MPEP 609—Concise explanation of the relevance includes issue date of KR OA and references cited therein.
European Search Report for EP Application No. 20188860.9 dated Jan. 18, 2021, citing the above references.
International Search Report; International Application No. 20 188 860.9; dated Feb. 13, 2023; 6 pages.

* cited by examiner

*Primary Examiner* — Forrest M Phillips
(74) *Attorney, Agent, or Firm* — Cantor Colburn LLP

(57) ABSTRACT

A sound absorption device and a method of manufacturing the same are provided. The sound absorption device includes a sound absorbing panel including first elements, second elements, third elements, and fourth elements arranged in different directions, wherein a cross-section of at least one of the first through fourth elements has a distorted circular shape, a distorted polygonal shape, or a distorted elliptical shape.

19 Claims, 11 Drawing Sheets

FIG. 5

| SAMPLE NAME | TEST ITEM | UNIT | TEST METHOD | TEST RESULT |
|---|---|---|---|---|
| Koptri-19-06-03584-1 | LIGHT TRANSMITTANCE | % | USE UV-Vis Spectrophotometer (at 450 nm) | 2.23 |
| | | | USE UV-Vis Spectrophotometer (at 550 nm) | 2.33 |
| | | | USE UV-Vis Spectrophotometer (at 650 nm) | 2.37 |
| Koptri-19-06-03584-2 | LIGHT TRANSMITTANCE | % | USE UV-Vis Spectrophotometer (at 450 nm) | 3.13 |
| | | | USE UV-Vis Spectrophotometer (at 550 nm) | 3.39 |
| | | | USE UV-Vis Spectrophotometer (at 650 nm) | 3.56 |
| Koptri-19-06-03584-3 | LIGHT TRANSMITTANCE | % | USE UV-Vis Spectrophotometer (at 450 nm) | 10.2 |
| | | | USE UV-Vis Spectrophotometer (at 550 nm) | 10.7 |
| | | | USE UV-Vis Spectrophotometer (at 650 nm) | 10.9 |
| Koptri-19-06-03584-4 | LIGHT TRANSMITTANCE | % | USE UV-Vis Spectrophotometer (at 450 nm) | 11.9 |
| | | | USE UV-Vis Spectrophotometer (at 550 nm) | 12.4 |
| | | | USE UV-Vis Spectrophotometer (at 650 nm) | 12.8 |

SOUND ABSORPTION DEVICE AND METHOD OF MANUFACTURING THE SAME

CROSS-REFERENCE TO RELATED APPLICATION

This application claims the benefit of Korean Patent Application No. 10-2019-0095164, filed on Aug. 5, 2019, in the Korean Intellectual Property Office, the disclosure of which is incorporated herein in its entirety by reference.

BACKGROUND

1. Field

One or more embodiments relate to a sound absorption device including a thin sound absorbing panel and a method of manufacturing the sound absorption device.

2. Description of Related Art

Methods of controlling sound are classified into three types: reflection, sound absorption, and dispersion. In the case of a sound absorption method, sound absorption performance and a frequency domain are controlled using a porous structure, such as sponge or polymer felt, having a porosity of at least 90% or using a resonator or a micro-perforated panel (MPP), each having a high sound absorption property in a certain frequency band.

Regarding the polymer, metal sponge, and felt, which are materials usually used as a sound absorber, the absorption performance of the material in a wide range of frequencies is increased by increasing the porosity of the material to match the impedance of air with the impedance of a sound absorbing structure and by increasing the thickness of the material to at least 20 mm. In addition, to increase the sound absorption performance at a certain frequency, a resonator or an MPP is attached to walls or surfaces of materials of cars or submarines.

Resonators, which have a complex inner structure and are made of rigid materials, may usually be manufactured as the surface of a soundproof wall, the surface of a wall, or the inner structure of a speaker because of the inner shape that reacts to a certain frequency. Resonators may be arranged in various sizes but may not be arranged to overlap each other in the thickness direction (e.g., the Z-axis direction) of a soundproof wall or the like. Resonators have a high sound absorption property at a certain frequency but are bulky and not easy to manufacture.

MPPs are manufactured by uniformly forming air tubes across the surface of a rigid body, such as a wooden, metal, or glass body, to penetrate the rigid body. Unlike resonators, MPPs are thin but are difficult to use in various fields because their sound absorption performance is selectively high only at a certain frequency of 1 kHz or less.

SUMMARY

One or more embodiments include a sound absorbing panel having a spiral-shaped micropore and a sound absorption device including the sound absorbing panel.

One or more embodiments include a sound absorption device including a thin sound absorbing panel and a method of manufacturing the sound absorption device.

Additional aspects will be set forth in part in the description which follows and, in part, will be apparent from the description, or may be learned by practice of the presented embodiments of the disclosure.

According to one or more embodiments, a sound absorption device includes a sound absorbing panel including first elements, second elements, third elements, and fourth elements, the first elements being spaced apart from each other along a first direction, the second elements being arranged on the first elements and being spaced apart from each other along a second direction different from the first direction; the third elements being arranged on the second elements and being spaced apart from each other along a third direction different from the second direction, and the fourth elements being arranged on the third elements and being spaced apart from each other along a fourth direction different from the third direction, wherein a cross-section of at least one of the first through fourth elements has a distorted circular shape, a distorted polygonal shape, or a distorted elliptical shape, and a thickness of the sound absorbing panel is about 2 mm or less.

A ratio of a short-axis length to a long-axis length of the cross-section of the at least one of the first through fourth elements may be about 80% or less.

The long-axis length may be about 500 μm or less.

The sound absorbing panel may include a plurality of pores having a spiral shape in a thickness direction of the sound absorbing panel.

An angle between the first direction and the second direction may be greater than 10° and less than or equal to 90°.

At least one of the first through fourth elements may have a long bar shape.

At least one of the first through fourth elements may include a polymer filament.

A transparency of the sound absorbing panel may be about 80% or greater.

The sound absorption device may further include a first substrate spaced apart from the sound absorbing panel.

The first substrate may include a transparent material.

The first substrate may include glass.

A gap between the sound absorbing panel and the first substrate may be about 40 mm or less.

The sound absorption device may further include a second substrate facing the first substrate with the sound absorbing panel between the first substrate and the second substrate.

The sound absorption device may further include another sound absorbing panel spaced apart from the sound absorbing panel.

The sound absorption device may absorb sound waves having frequencies of about 1000 Hz to about 4000 Hz at a sound absorption coefficient of at least 0.5.

According to one or more embodiments, a method of manufacturing a sound absorption device includes forming a sound absorbing panel by forming first elements spaced apart from each other in a first direction, forming second elements on the first elements to be spaced apart from each other in a second direction different from the first direction, forming third elements on the second elements to be spaced apart from each other in a third direction different from the second direction, and forming fourth elements on the third elements to be spaced apart from each other in a fourth direction different from the third direction, wherein a cross-section of at least one of the first through fourth elements has one of a distorted circular shape, a distorted polygonal shape, and a distorted elliptical shape, and a thickness of the sound absorbing panel is about 2 mm or less.

The method may further include applying a pressure to at least one of the first through fourth elements.

An angle between the first direction and the second direction may be greater than 10° and less than or equal to 90°.

A transparency of the sound absorbing panel may be 80% or greater.

The method may further include forming a substrate spaced apart from the sound absorbing panel.

BRIEF DESCRIPTION OF THE DRAWINGS

The above and other aspects, features, and advantages of certain embodiments of the disclosure will be more apparent from the following description taken in conjunction with the accompanying drawings, in which:

FIG. 5 shows results of measuring transparency with respect to thicknesses of sound absorbing panels;

DETAILED DESCRIPTION

Figure 1:
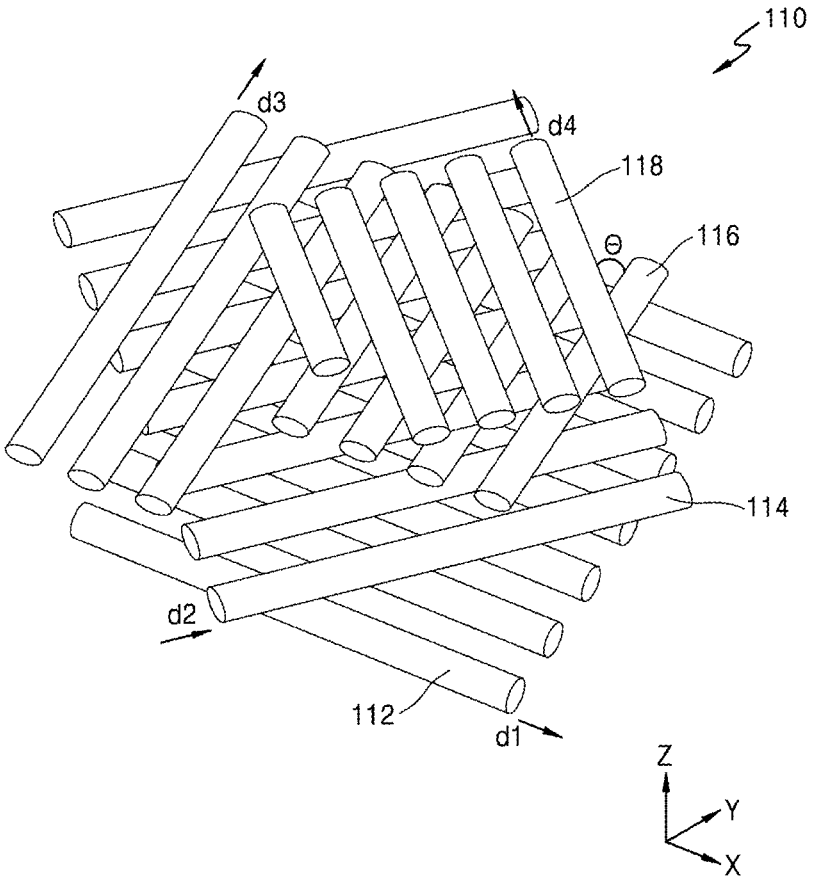
FIG. 1 is a conceptual diagram of a sound absorbing panel included in a sound absorption device, according to an embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

The terms "comprises", "comprising", "includes", and/or "including" used herein should not be interpreted as the definite presence of all components or steps described in the embodiments and should be interpreted as the absence of some components or steps or the addition of one or more other components or steps.

When a component is referred to as being "above" or "on" another component, it may be directly above, below, on the left, or on the right in contact with the other component or may be above, below, on the left, or on the right with no contact with the other component. Hereinafter, detailed descriptions will be made based on only embodiments with reference to the drawings.

While such terms "first," "second," etc., may be used to describe various components, such components must not be limited to the above terms. The above terms are used only to distinguish one component from another.

Figure 2:
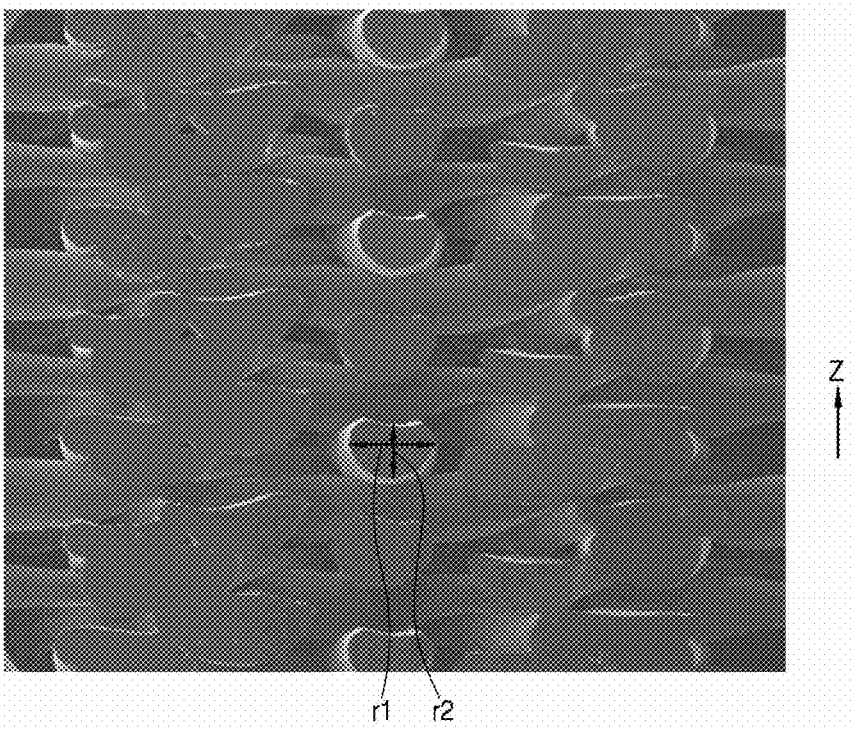
FIG. 2 is a diagram of a cross-section of the sound absorbing panel of FIG. 1.

FIG. 1 is a conceptual diagram of a sound absorbing panel 110 included in a sound absorption device, according to an embodiment. FIG. 2 is a diagram of a cross-section of the sound absorbing panel 110 of FIG. 1.

Referring to FIG. 1, the sound absorbing panel 110 may be formed by arranging a plurality of elements. The elements may have a long bar shape and may include a polymer filament, plaster, metal powder, etc.

The orientation angles of the elements may sequentially change in a thickness direction (e.g., a Z-axis direction) of the sound absorbing panel 110. The elements may be divided into first elements 112, second elements 114, third elements 116, and fourth elements 118 by layers. For example, the sound absorbing panel 110 may include the first elements 112 which are spaced apart from each other along a first direction; the second elements 114 which are in contact with the first elements 112 and are spaced apart from each other along a second direction different from the first direction; the third elements 116 which are in contact with the second elements 114 and are spaced apart from each other along a third direction different from the second direction; and the fourth elements 118 which are in contact with the third elements 114 and are spaced apart from each other along a fourth direction different from the third direction.

The first elements 112 may be arranged in a line such that a length direction d1 of the first elements 112 is parallel with an X-axis direction. When a length direction of elements is parallel with the X-axis direction, it may be defined as an orientation angle of 0°. Accordingly, the orientation angle of the first elements 112 may be 0°. The first elements 112 may be spaced apart from each other.

The second elements 114 may be arranged on the first elements 112 in the thickness direction (e.g., the Z-axis direction) of the sound absorbing panel 110. A portion of the second elements 114 may be in contact with a portion of the first elements 112. A length direction d2 of the second elements 114 may be different from the length direction d1 of the first elements 112. For example, the orientation angle of the second elements 114 may be 45°. The second elements 114 may be spaced apart from each other.

The third elements 116 may be arranged on the second elements 114 in the thickness direction (e.g., the Z-axis direction) of the sound absorbing panel 110. A portion of the third elements 116 may be in contact with a portion of the second elements 114. A length direction d3 of the third elements 116 may be different from the length direction d2 of the second elements 114. For example, the length direction d3 of the third elements 116 may be different from the length direction d2 of the second elements 114 by 45°. In other words, the orientation angle of the third elements 116 may be 90°. The third elements 116 may be spaced apart from each other.

The fourth elements 118 may be arranged on the third elements 116 in the thickness direction (e.g., the Z-axis direction) of the sound absorbing panel 110. A portion of the fourth elements 118 may be in contact with a portion of the third elements 116. A length direction d4 of the fourth elements 118 may be different from the length direction d3 of the third elements 116. For example, the length direction d4 of the fourth elements 118 may be displaced from the length direction d3 of the third elements 116 by 45°. In other words, the orientation angle of the fourth elements 118 may be 135°. The fourth elements 118 may be spaced apart from each other.

The angle between the orientation angles of respective adjacent elements in the thickness direction of the sound absorbing panel 110 may be greater than 10° and less than or equal to 90°. For example, the angle between the orientation angles of respective adjacent elements in the thickness direction of the sound absorbing panel 110 may be equal to or greater than 20° and less than 60°. Referring to FIG. 1, the orientation angles of the first through fourth elements 112, 114, 116, and 118 sequentially change by a certain amount. However, embodiments are not limited thereto. An angle θ between adjacent orientation angles of the first through fourth elements 112, 114, 116, and 118 may not be constant. For instance, the first elements 112 may be arranged at an orientation angle of 0°, the second elements 114 may be arranged at an orientation angle of 30°, the third elements 116 may be arranged at an orientation angle of 70°, and the fourth elements 118 may be arranged at an orientation angle of 120°.

According to an embodiment, the first through fourth elements 112, 114, 116, and 118 may be repeated a plurality of times in the thickness direction (e.g., the Z-axis direction) of the sound absorbing panel 110. According to the arrangements of the first through fourth elements 112, 114, 116, and 118, stair-shaped or spiral-shaped pores may be formed in the sound absorbing panel 110 in the thickness direction (e.g., the Z-axis direction) of the sound absorbing panel 110. In other words, a pore formed by the first elements 112 partially overlaps a pore formed by the second elements 114 both in the thickness direction (e.g., the Z-axis direction) and in a direction perpendicular to the thickness direction (e.g., the Z-axis direction). The pore formed by the second elements 114 partially overlaps a pore formed by the third elements 116 both in the thickness direction (e.g., the Z-axis direction) and in the perpendicular direction to the thickness direction (e.g., the Z-axis direction).

At least two of the distances between two adjacent ones of the first through fourth elements 112, 114, 116, and 118 may be different in the thickness direction of the sound absorbing panel 110. The distances among the first through fourth elements 112, 114, 116, and 118 may be controlled by a flow rate at which the first through fourth elements 112, 114, 116, and 118 are formed. For example, when the first through fourth elements 112, 114, 116, and 118 are formed using three-dimensional (3D) printing, the distances among the first through fourth elements 112, 114, 116, and 118 may be controlled by the flow rate of a source forming the first through fourth elements 112, 114, 116, and 118.

The cross-sections of the first through fourth elements 112, 114, 116, and 118 in the thickness direction (e.g., the Z-axis direction) of the sound absorbing panel 110 may have at least one shape selected from a distorted circular shape, a distorted polygonal shape, and a distorted elliptical shape. The cross-sections of the first through fourth elements 112, 114, 116, and 118 may be distorted by applying a pressure to the first through fourth elements 112, 114, 116, and 118 during the manufacture of the sound absorbing panel 110. Accordingly, the sound absorbing panel 110 may be made thin. For example, as shown in FIG. 2, a long-axis length r1 of a cross-section of an element may be perpendicular to the thickness direction (e.g., the Z-axis direction) of the sound absorbing panel 110, and a short-axis length r2 of the cross-section may be parallel with the thickness direction (e.g., the Z-axis direction) of the sound absorbing panel 110. In other words, the pressure may be applied in a direction parallel with the thickness direction (e.g., the Z-axis direction) of the sound absorbing panel 110. A ratio of the short-axis length r2 to the long-axis length r1 may be inversely proportional to the pressure applied to the sound absorbing panel 110. For example, the ratio of the short-axis length r2 to the long-axis length r1 may be 80% or less. The long-axis length r1 may be 400 μm or less.

Even though a pressure is applied to the sound absorbing panel 110 to decrease the thickness of the sound absorbing panel 110, stair- or spiral-shaped pores of the sound absorbing panel 110 may be maintained because the first through fourth elements 112, 114, 116, and 118 are arranged spaced apart or displaced from each other. For example, to make the sound absorbing panel 110 to be a thin type, a pressure may be applied to the sound absorbing panel 110 such that the thickness of the sound absorbing panel 110 is 2 mm or less. Although the sound absorbing panel 110 is thin, the spiral-shaped pores of the sound absorbing panel 110 may make the travel of sound waves complicated such that the sound waves collide into the sound absorbing panel 110 and dissipate.

In addition, because spiral-shaped pores having various lengths are arranged in the sound absorbing panel 110, a wide range of sound waves may be absorbed. The sound absorbing panel 110 including spiral-shaped microsize pores may be referred to as a microstructured sound absorption panel (MAP).

Since the sound absorbing panel 110 is thin, the sound absorbing panel 110 may be transparent. For example, the sound absorbing panel 110 may have a light transmittance of about 2% to about 15%. A transparent sound absorbing panel may minimize the influence of optical properties of other devices with which the transparent sound absorbing panel is combined. For example, the sound absorbing panel 110 may be combined with a double-glazed window to absorb sound. The sound absorbing panel 110 may be combined with other components to form a sound absorption device 200 of FIG. 6.

Figure 3:
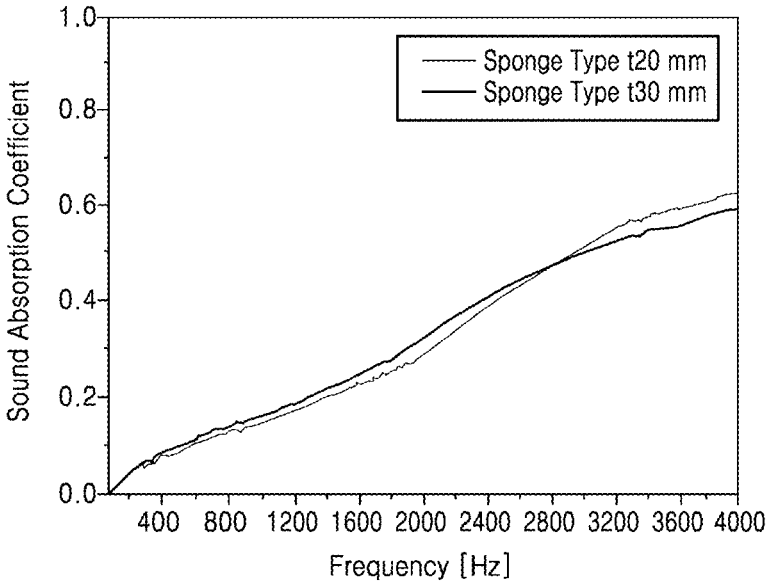
FIG. 3 shows results of testing the sound absorption performance of sponge type sound absorbing panels as comparative examples.

FIG. 3 shows results of testing the sound absorption performance of sponge type sound absorbing panels as comparative examples. As shown in FIG. 3, sponge may absorb, at a sound absorption coefficient of 0.5 or greater, sound waves having a high frequency of about 3000 Hz or greater. Sponge usually has a high sound absorption coefficient with respect to high-frequency sound waves. Therefore, there is a limit to using sponge for a sound absorbing panel that absorbs low-frequency noise in daily life.

Figure 4:
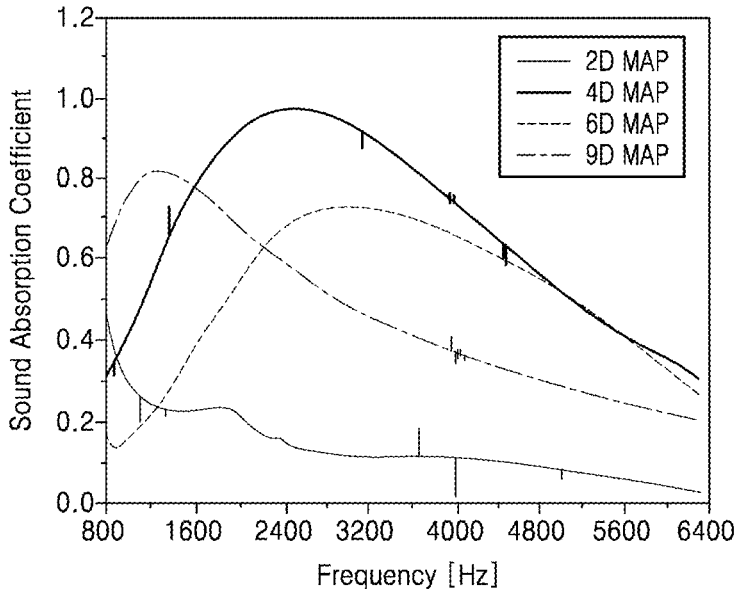
FIG. 4 shows results of testing the sound absorption performance of sound absorbing panels including arrangement of elements according to an embodiment.

FIG. 4 shows results of testing the sound absorption performance of sound absorbing panels including the arrangement of elements according to an embodiment.

In FIG. 4, "2D MAP" indicates that an angle between the orientation angles of two adjacent elements in the thickness direction (e.g., the Z-axis direction) of a sound absorbing panel is 90°. For example, "2D MAP" may indicate a sound absorbing panel which has elements arranged at an orientation angle of 0° in an odd-numbered layer and elements arranged at an orientation angle of 90° in an even-numbered layer. "4D MAP" indicates that an angle between the orientation angles of two adjacent elements in the thickness direction (e.g., the Z-axis direction) of a sound absorbing panel is 45°. For example, "4D MAP" may indicate a sound absorbing panel which has elements arranged at an orientation angle of 0° in a 4(k-1)+1-th layer, elements arranged at an orientation angle of 45° in a 4(k-1)+2-th layer, elements arranged at an orientation angle of 90° in a 4(k-1)+3-th layer, and elements arranged at an orientation angle of 135° in a 4(k-1)+4-th layer, where "k" is a natural number. "6D MAP" indicates a sound absorbing panel in which an angle between the orientation angles of two adjacent elements in the thickness direction (e.g., the Z-axis direction) of a sound absorbing panel is 30° and which has at least six layers of elements. "9D MAP" indicates a sound absorbing panel in which an angle between the orientation angles of two adjacent elements in the thickness direction (e.g., the Z-axis direction) of a sound absorbing panel is 20° and which has at least nine layers of elements.

It may be seen that a sound absorbing panel having at least 45° as an angle between two adjacent orientation angles absorbs sound waves in a wider range of frequencies. In particular, it may be seen that a sound absorbing panel corresponding to 4D MAP absorbs sound waves having frequencies of about 1600 Hz to about 4800 Hz at a sound absorption coefficient of at least 0.5 and a sound absorbing panel corresponding to 6D MAP absorbs sound waves having frequencies of about 2000 Hz to about 4800 Hz at a sound absorption coefficient of at least 0.5.

While pores of the sound absorbing panel corresponding to 2D MAP have a straight line shape, pores of sound absorbing panels respectively corresponding to 4D MAP, 6D MAP, and 9D MAP have a spiral shape. It may be seen that a sound absorbing panel including spiral-shaped pores efficiently absorbs sound waves in a wide range of frequencies. It may be seen that the sound absorbing panel also absorbs 1000 Hz sound waves. Accordingly, when a sound absorbing panel is manufactured, an angle between orientation angles may be adjusted according to the frequency band of sound waves to be absorbed.

According to an embodiment, the sound absorbing panel 110 is thin and includes spiral-shaped pores, thereby having high transparency. For example, FIG. 5 shows results of measuring transparency with respect to thicknesses of the sound absorbing panel 110.

Figure 6:
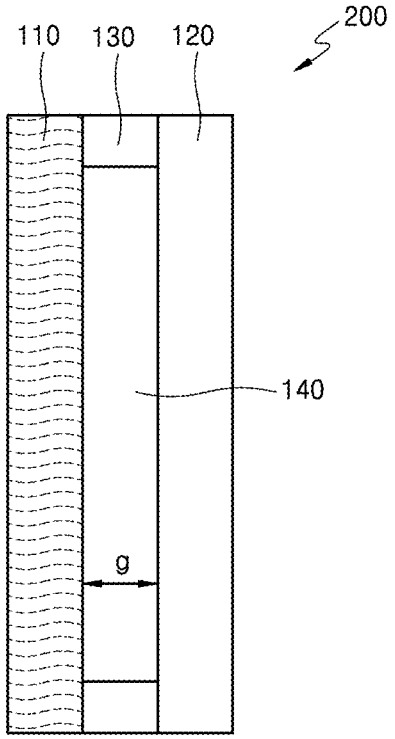
FIG. 6 is a diagram of a sound absorption device including the sound absorbing panel of FIG. 1, according to an embodiment.

FIG. 6 is a diagram of the sound absorption device 200 including the sound absorbing panel 110 of FIG. 1, according to an embodiment. Referring to FIG. 6, the sound absorption device 200 may include the sound absorbing panel 110, which is formed by arranging a plurality of elements, and a substrate 120 spaced apart from the sound absorbing panel 110. The sound absorbing panel 110 has been described above, and thus detailed descriptions thereof will be omitted. The substrate 120 may be transparent. For example, the substrate 120 may include polymethylmethacrylate (PMMA), a transparent glass material mainly including SiO2, or the like. The substrate 120 is not limited to those materials but may include a plastic material.

The sound absorption device 200 may further include a spacer 130 which maintains a gap between the sound absorbing panel 110 and the substrate 120. When the spacer 130 is provided, the space between the sound absorbing panel 110 and the substrate 120 may be filled with a gas such as the air. The gap between the sound absorbing panel 110 and the substrate 120 may be about 5 mm to about 40 mm. The gap between the sound absorbing panel 110 and the substrate 120 may be referred to as a gap layer 140. The gap layer 140 may increase the sound absorption coefficient of sound waves by enhancing the resonance characteristic of the sound waves. In addition, a sound absorption frequency band may vary with the thickness of the gap layer 140.

Figure 7:
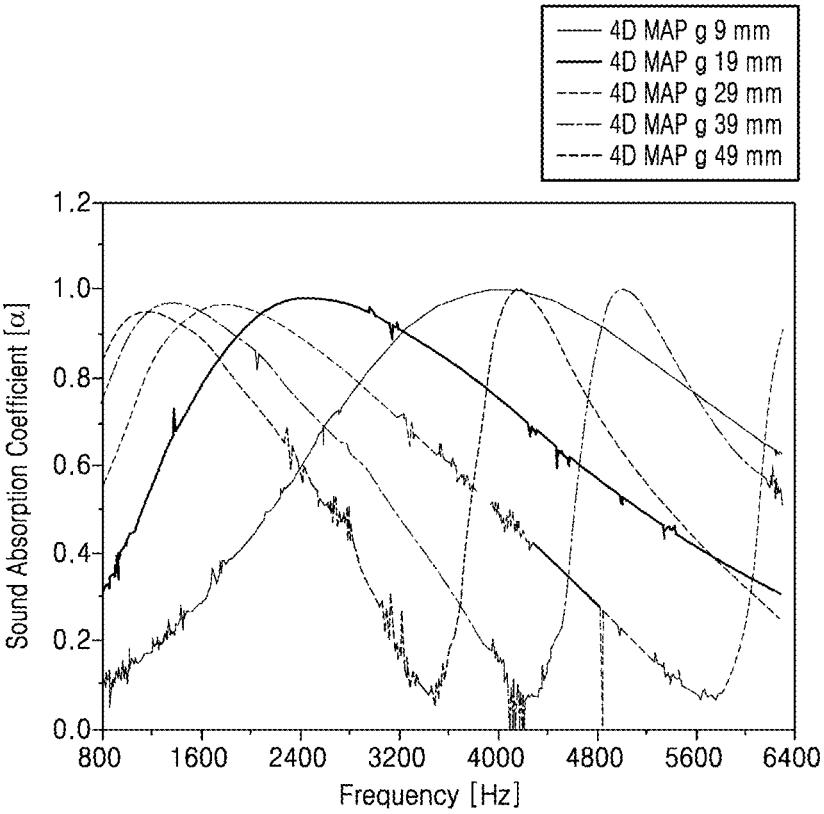
FIG. 7 shows results of testing sound absorption properties with respect to gaps between a sound absorbing panel and a substrate, according to an embodiment.

FIG. 7 shows results of testing sound absorption properties with respect to gaps between the sound absorbing panel 110 and the substrate 120, according to an embodiment. Sound absorption properties were tested when the gaps between the sound absorbing panel 110 corresponding to "4D MAP" and the substrate 120, i.e., the thicknesses of the gap layer 140, were 9 mm, 19 mm, 29 mm, 39 mm, and 49 mm. According to the results, the central frequency of absorbed sound waves decreased as the thickness of the gap layer 140 increased. In particular, when the thickness of the gap layer 140 were 9 mm, 19 mm, and 29 mm, a wide range of sound waves including a low frequency band were absorbed. Accordingly, the sound absorption device 200 absorbing a wide range of sound waves including a low frequency band may be designed such that the gap between the sound absorbing panel 110 and the substrate 120 is about 5 mm to about 40 mm.

Figure 8:
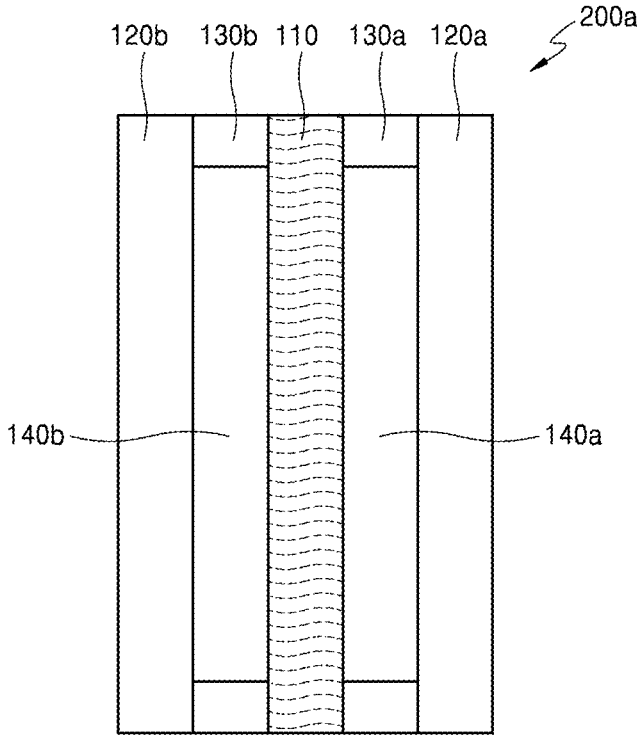
FIG. 8 is a schematic diagram of a sound absorption device including a plurality of substrates, according to one or more embodiments.

FIG. 8 is a schematic diagram of a sound absorption device 200*a* including a plurality of substrates, according to one or more embodiments. Referring to FIG. 8, the sound absorption device 200*a* may include a first substrate 120*a* and a second substrate 120*b*, which are spaced apart from each other with the sound absorbing panel 110 therebetween. The sound absorbing panel 110 is formed by arranging a plurality of elements, as described above, and thus detailed descriptions thereof will be omitted. The first and second substrates 120*a* and 120*b* may include a transparent substrate. For example, the first and second substrates 120*a* and 120*b* may include PMMA, a transparent glass material mainly including SiO2, or the like but are not limited thereto.

The sound absorption device 200*a* may further include a first spacer 130*a*, which maintains a gap between the sound absorbing panel 110 and the first substrate 120*a*, and a second spacer 130*b*, which maintains a gap between the sound absorbing panel 110 and the second substrate 120*b*. When the first and second spacers 130*a* and 130*b* are provided, the space between the sound absorbing panel 110 and each of the first and second substrates 120*a* and 120*b* may be filled with a gas such as the air. The gap between the sound absorbing panel 110 and each of the first and second substrates 120*a* and 120*b* may be about 5 mm to about 40 mm.

Because the first and second substrates 120*a* and 120*b* are spaced apart from each other with the sound absorbing panel 110 therebetween, the sound absorption device 200*a* of FIG. 8 may absorb sound waves entering in opposite directions. For example, the sound absorbing panel 110 and a first gap layer 140*a* between the sound absorbing panel 110 and the first substrate 120*a* may absorb sound waves entering the second substrate 120*b* from outside, and the sound absorbing panel 110 and a second gap layer 140*b* between the sound absorbing panel 110 and the second substrate 120*b* may absorb sound waves entering the first substrate 120*a* from outside.

Figure 9:
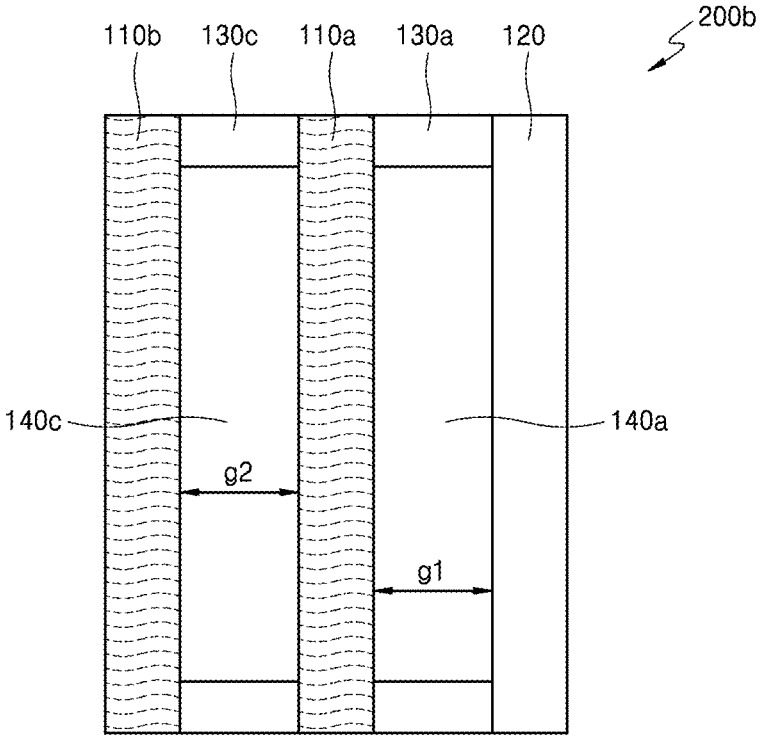
FIG. 9 is a schematic diagram of a sound absorption device including a plurality of substrates, according to one or more embodiments.

FIG. 9 is a schematic diagram of a sound absorption device 200*b* including a plurality of sound absorbing panels, according to one or more embodiments. Referring to FIG. 9, the sound absorption device 200*b* may include the substrate 120, a first sound absorbing panel 110*a*, and a second sound absorbing panel 110*b*, which are sequentially arranged to be spaced apart from one another. Each of the first and second sound absorbing panels 110*a* and 110*b* is formed by arranging a plurality of elements, as described above, and thus detailed descriptions thereof will be omitted. The first gap layer 140*a* may be formed between the substrate 120 and the first sound absorbing panel 110*a*, and a third gap layer 140*c* may be formed between the first sound absorbing panel 110*a* and the second sound absorbing panel 110*b*. The frequencies of sound waves absorbed by each of the first and second sound absorbing panels 110*a* and 110*b* may vary with the material of elements, the distance between adjacent elements, the thickness of the first or second sound absorbing panel 110*a* or 110*b*, the shape of pores, and the thickness and material of each of the first and third gap layers 140*a* and 140*c*. The first and second sound absorbing panels 110*a* and 110*b* and the first and third gap layers 140*a* and 140*c* may increase a sound absorption frequency band.

Figure 10:
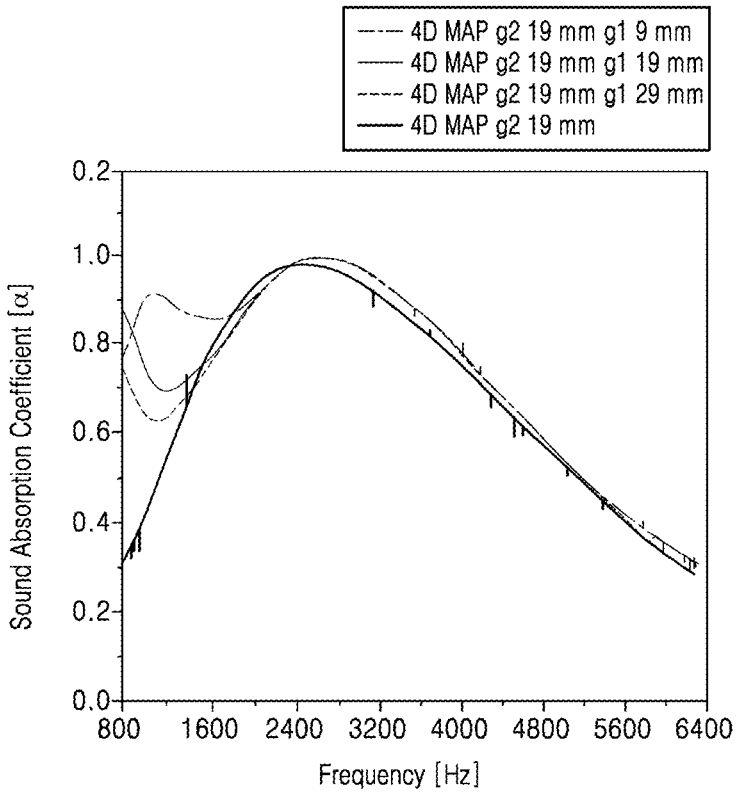
FIG. 10 shows the results of testing the sound absorption property of a sound absorption device including a plurality of sound absorbing panels.

FIG. 10 shows the results of testing the sound absorption property of a sound absorption device including a plurality of sound absorbing panels. It is seen that sound waves in a low frequency band may be absorbed more when a plurality of gap layers are formed using a plurality of sound absorbing panels than when a single sound absorbing panel and a single gap layer are used to absorb sound waves.

Figure 11:
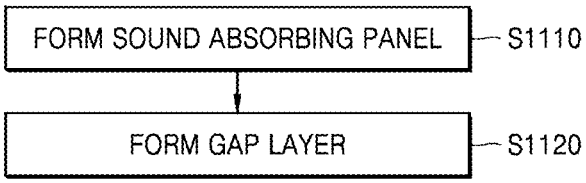
FIG. 11 is a flowchart of a method of manufacturing a sound absorption device.

FIG. 11 is a flowchart of a method of manufacturing a sound absorption device.

The sound absorbing panel 110 may be formed by arranging a plurality of elements in three dimensions in operation S1110. The elements may have a long bar shape. The elements may be may be divided into the first elements 112, the second elements 114, the third elements 116, and the fourth elements 118 by layers. The sound absorbing panel 110 may be formed by repeatedly forming the first elements 112 spaced apart from each other in a first direction, the second elements 114 on the first elements 112 to be spaced apart from each other in a second direction different from the first direction, the third elements 116 on the second elements 114 to be spaced apart from each other in a third direction different from the second direction, and the fourth elements 118 on the third elements 116 to be spaced apart from each other in a fourth direction different from the third direction. The first through fourth elements 112, 114, 116, and 118 may be formed using 3D printing The orientation angles of the first through fourth elements 112, 114, 116, and 118 may sequentially change. For example, the angle between the orientation angles of respective elements adjacent to each other in the thickness direction of the sound absorbing panel 110 may be greater than 10° and less than or equal to 90°. Accordingly, the sound absorbing panel 110 may include spiral-shaped pores. The angle between orientation angles may be constant or inconstant.

A pressure may be applied to the sound absorbing panel 110 during the formation of the sound absorbing panel 110. For example, when each of the respective layers of the second through fourth elements 114, 116, and 118 is formed, a pressure may be applied respectively. Alternatively, after the sound absorbing panel 110 is completely formed, the thickness of the sound absorbing panel 110 may be reduced by applying a pressure to the sound absorbing panel 110. The first through fourth elements 112, 114, 116, and 118 may have at least one shape selected from a distorted circular shape, a distorted polygonal shape, and a distorted elliptical shape, and the thickness of the sound absorbing panel 110 may be 2 mm or less.

The gap layer 140 may be formed by forming the substrate 120 spaced apart from the sound absorbing panel 110 in operation S1120. For example, the gap layer 140 may be formed by arranging the sound absorbing panel 110 and the substrate 120 to be spaced apart from each other and arranging the spacer 130 fixing the sound absorbing panel 110 and the substrate 120. The gap layer 140 may absorb incident sound waves by allowing the sound waves to resonate.

Manufacturing conditions may be changed according to the frequency band of sound waves to be absorbed by a sound absorbing panel and a sound absorption device.

A wide range of sound waves including low and medium frequencies may be absorbed using a sound absorbing panel and a gap layer.

The sound absorption device may be applied to various fields because the sound absorption device uses a thin sound absorbing panel.

The sound absorption device may be applied to various fields because the sound absorption device uses a sound absorbing panel having a high transparency.

The sound absorbing panel is porous and thus easily used together with other sound absorbing structures.

The sound absorbing panel may be easily applied to various fields and surfaces because the sound absorbing panel is manufactured using a flexible material.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the disclosure as defined by the following claims.

What is claimed is:

1. A sound absorption device comprising a sound absorbing panel absorbing sound waves and including first elements, second elements, third elements, and fourth elements, the first elements being spaced apart from each other along a first direction, the second elements being arranged on the first elements and being spaced apart from each other along a second direction different from the first direction; the third elements being arranged on the second elements and being spaced apart from each other along a third direction different from the second direction, and the fourth elements being arranged on the third elements and being spaced apart from each other along a fourth direction different from the third direction, wherein a cross-section of at least one of the first through fourth elements has one of a distorted circular shape, a distorted polygonal shape, and a distorted elliptical shape, and a thickness of the sound absorbing panel is about 2 mm or less, and wherein an angle between orientation angles of respective adjacent elements of the first elements, second elements, third elements, and fourth elements in the thickness direction of the sound absorbing panel is greater than 10° and less than 45° and the sound absorbing panel includes a plurality of pores having a spiral shape in a thickness direction of the sound absorbing panel.

2. The sound absorption device of claim 1, wherein a ratio of a short-axis length to a long-axis length of the cross-section of the at least one of the first through fourth elements is about 80% or less.

3. The sound absorption device of claim 2, wherein the long-axis length is about 500 μm or less.

4. The sound absorption device of claim 1, wherein an angle between the first direction and the second direction is greater than 10° and less than or equal to 90°.

5. The sound absorption device of claim 1, wherein at least one of the first through fourth elements has a long bar shape.

6. The sound absorption device of claim 1, wherein at least one of the first through fourth elements includes a polymer filament.

7. The sound absorption device of claim 1, wherein a transparency of the sound absorbing panel is about 80% or greater.

8. The sound absorption device of claim 1, wherein at least two distances between two adjacent elements of the first through fourth elements are different in a thickness direction of the sound absorbing panel.

9. The sound absorption device of claim 1, further comprising a first substrate spaced apart from the sound absorbing panel.

10. The sound absorption device of claim 9, wherein the first substrate includes a transparent material.

11. The sound absorption device of claim 9, wherein a gap between the sound absorbing panel and the first substrate is about 40 mm or less.

12. The sound absorption device of claim 9, further comprising a second substrate facing the first substrate with the sound absorbing panel between the first substrate and the second substrate.

13. The sound absorption device of claim 1, further comprising another sound absorbing panel spaced apart from the sound absorbing panel.

14. The sound absorption device of claim 1, wherein the sound absorption device absorbs sound waves having frequencies of about 2000 Hz to about 4000 Hz at a sound absorption coefficient of at least 0.5.

15. A method of manufacturing a sound absorption device, the method comprising forming a sound absorbing panel absorbing sound waves by forming first elements spaced apart from each other in a first direction, forming second elements on the first elements to be spaced apart from each other in a second direction different from the first direction, forming third elements on the second elements to be spaced apart from each other in a third direction different from the second direction, and forming fourth elements on the third elements to be spaced apart from each other in a fourth direction different from the third direction, wherein a cross-section of at least one of the first through fourth elements has one of a distorted circular shape, a distorted polygonal shape, and a distorted elliptical shape, and a thickness of the sound absorbing panel is about 2 mm or less, and wherein an angle between orientation angles of respective adjacent elements of the first elements, second elements, third elements, and fourth elements in the thickness direction of the sound absorbing panel is greater than 10° and less than 45° and the sound absorbing panel includes a plurality of pores having a spiral shape in a thickness direction of the sound absorbing panel.

16. The method of claim 15, further comprising applying a pressure to at least one of the first through fourth elements.

17. The method of claim 15, wherein an angle between the first direction and the second direction is greater than 10° and less than or equal to 90°.

18. The method of claim 15, wherein a transparency of the sound absorbing panel is about 80% or greater.

19. The method of claim 15, further comprising forming a substrate spaced apart from the sound absorbing panel.

* * * * *